US009073371B1

(12) United States Patent
Ishikawa et al.

(10) Patent No.: US 9,073,371 B1
(45) Date of Patent: Jul. 7, 2015

(54) CUTTER APPARATUS AND PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/628,369

(22) Filed: Feb. 23, 2015

(51) Int. Cl.
*B41J 13/10* (2006.01)
*B41J 11/70* (2006.01)

(52) U.S. Cl.
CPC ..... *B41J 11/70* (2013.01); *B41J 13/106* (2013.01)

(58) Field of Classification Search
USPC ..... 400/621; 347/101, 104, 218
See application file for complete search history.

(56) References Cited

U.S. PATENT DOCUMENTS

| | | | | |
|---|---|---|---|---|
| 6,814,515 | B2 | 11/2004 | Tsuchiya et al. | |
| 8,746,117 | B2 * | 6/2014 | Kondo et al. | 83/112 |
| 2007/0065217 | A1 * | 3/2007 | Yoshioka | 400/621 |
| 2012/0204693 | A1 * | 8/2012 | Yoshida | 83/105 |
| 2012/0272805 | A1 * | 11/2012 | Kondo et al. | 83/102 |

FOREIGN PATENT DOCUMENTS

| | | | | |
|---|---|---|---|---|
| JP | 2001-246593 | * | 9/2001 | B26D 1/08 |
| JP | 2001-293684 | * | 10/2001 | B26D 1/08 |
| JP | 2003-019845 | | 1/2003 | |

* cited by examiner

*Primary Examiner* — Huan Tran
(74) *Attorney, Agent, or Firm* — IPUSA, PLLC

(57) ABSTRACT

A cutter apparatus includes a fixed blade, a movable blade that moves toward the fixed blade to cut a recording paper, a housing to which the fixed blade is attached, and a discharge port that discharges the recording paper. The discharge port includes a lower paper guide attached to the housing for guiding a lower side of the recording paper. The lower paper guide includes an inner guide part formed on an inner side of the housing toward a side of the fixed blade and the movable blade, an outer guide part formed on an outer side of the housing, and a support part attached to the housing.

6 Claims, 4 Drawing Sheets

CUTTER APPARATUS AND PRINTER

CROSS-REFERENCE TO RELATED APPLICATIONS

This application is based upon and claims the benefit of priority of the prior Japanese Patent Application No. 2014-039617 filed on Feb. 28, 2014, the entire contents of which are incorporated herein by reference.

FIELD

The embodiments discussed herein are related to a cutter apparatus and a printer.

BACKGROUND

A printer that prints out receipts or the like is widely used for various purposes such as for a cash register of a store, or an ATM (Automated Teller Machine) or a CD (Cash Dispenser) of a bank. Such a printer includes a roll of heat sensitive paper to be used as recording paper. The printer prints, for example, letters on the recording paper by way of a thermal head or the like while the recording paper is conveyed. The recording paper is conveyed until the length of the recording paper reaches a predetermined length. Then, upon reaching the predetermined length, the recording paper is cut by a cutter.

A printer that cuts the recording paper with the cutter may have a fixed blade and a movable blade. By moving the movable blade toward the fixed blade, the recording paper is cut by the fixed blade and the movable blade.

[Patent Document 1]: Japanese Laid-Open Patent Publication No. 2003-19845

In a cutter apparatus, a movable blade is moved toward a fixed blade by rotating a drive motor for driving the movable blade, so that a recording paper or the like is cut by the fixed blade and the movable blade. The cut recording paper is guided along a recording paper guide and discharged from a discharge port.

To ensure room for mounting the fixed blade and the movable blade in the cutter apparatus, there is a space between the mounting area of the fixed blade and the movable blade and the discharge port. In a case where the recording paper enters this space, jamming of the recording paper may occur. When the jamming occurs, the printer cannot be used and would require maintenance. Particularly, in a case where the recording paper is rolled and has a resilient property or a significant curling property, jamming is more likely to occur.

SUMMARY

According to an aspect of the invention, there is a cutter apparatus including a fixed blade, a movable blade that moves toward the fixed blade to cut a recording paper, a housing to which the fixed blade is attached, and a discharge port that discharges the recording paper. The discharge port includes a lower paper guide attached to the housing for guiding a lower side of the recording paper. The lower paper guide includes an inner guide part formed on an inner side of the housing toward a side of the fixed blade and the movable blade, an outer guide part formed on an outer side of the housing, and a support part attached to the housing.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

DESCRIPTION OF EMBODIMENTS

Figure 1:
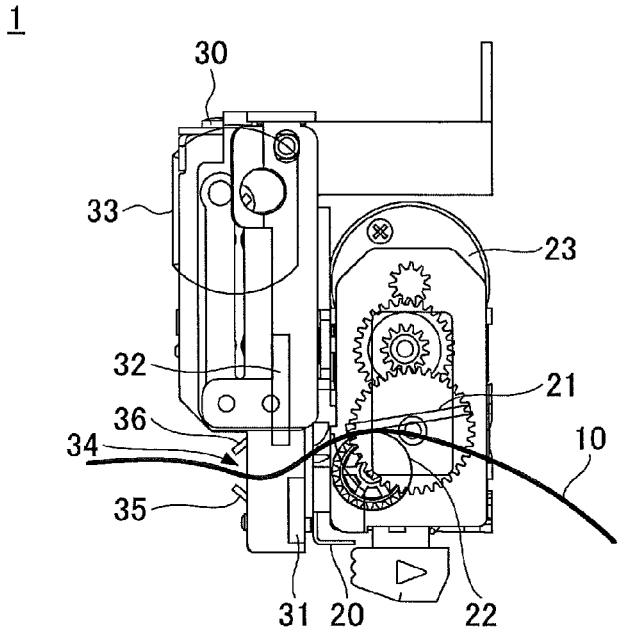
FIG. 1 is a schematic diagram illustrating a structure of a printer.

In the following, embodiments of the present invention are described with reference to the accompanying drawings. Like components are denoted with like reference numerals throughout the following description and are not further explained.

A cutter apparatus 30 and a printer 1 are described with reference to FIG. 1. The printer 1 performs printing on a rolled recording paper 10. The printer 1 includes, for example, a printer body 20 and the cutter apparatus 30. The printer body 20 includes, for example, a thermal head 21, a platen roller 22, and a conveying motor 23 for conveying the recording paper 10. The recording paper 10 is fed into the printer body 20 from a transfer port of the printer body 20. The cutter apparatus 30 includes a fixed blade 31, a movable blade 32, a movable blade motor 33 for driving the movable blade 32, and a gear (not illustrated) for transmitting dynamic force of the rotation of the movable blade motor 33 to the movable blade 32.

By rotating the conveying motor 23 in a state where the recording paper 10 is sandwiched between the thermal head 21 and the platen roller 22, the platen roller 22 rotates to convey the recording paper 10. The thermal head 21 performs printing on the recording paper 10 being conveyed by the rotation of the platen roller 22.

Figure 2:
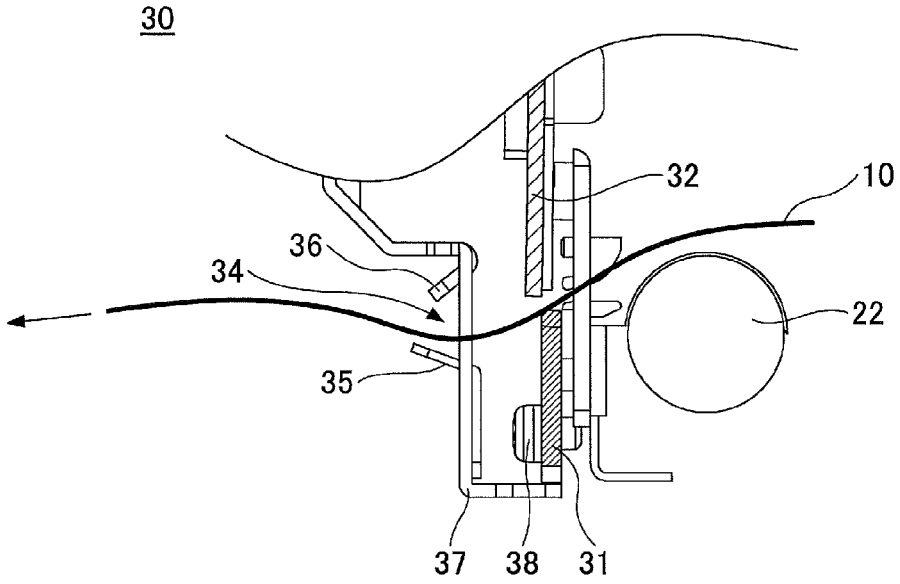
FIG. 2 is a schematic diagram for describing a cutter apparatus.

Then, the printed recording paper 10 is cut by the cutter apparatus 30. That is, after the printed recording paper 10 is conveyed to a predetermined position, the recording paper 10 is cut by the fixed blade 31 and the movable blade 32 by moving the movable blade 32 to a side of the fixed blade 31 by driving the movable blade motor 33. As illustrated in FIG. 2, the cutter apparatus 30 includes a discharge port 34 for discharging the cut recording paper 10. The discharge port 34 is formed by a lower paper guide 35 and an upper paper guide 36. The lower paper guide 35 and the upper paper guide 36 form a V-like shape spreading from the discharge port 34 to the side of the upper and lower paper guides 35, 36. That is, the discharge port 34 becomes narrower from the side of the upper and lower paper guides 35, 36 to an outer side of the discharge port 34.

The fixed blade 31 is attached to a housing 37 of the cutter apparatus 30 by a screw 38. Similarly, the lower paper guide 35 is fixed to the housing 37 by a screw (not illustrated). The upper paper guide 36 is formed by bending a part of the housing 37.

As illustrated in, for example, FIG. 1, the discharge port 34 is formed by the lower paper guide 35 and the upper paper guide 36. In a case where the recording paper 10 has high resiliency, the recording paper 10 is discharged from the discharge port 34 formed by the lower and upper paper guides 35, 36. However, in a case where the recording paper 10 has a low resiliency or a strong curling property, the recording paper 10 is folded between the lower and upper paper guides 34, 35 and causes jamming as illustrated in FIG. 3.

Figure 3:
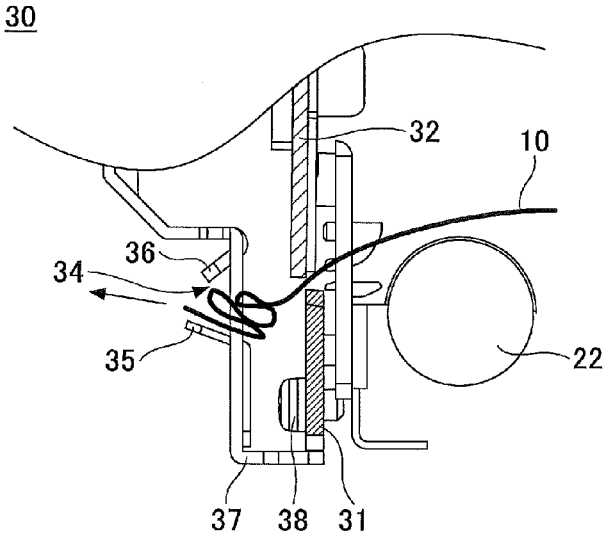
FIG. 3 is another schematic diagram for describing the cutter apparatus.

That is, with the printer 1 having the structure illustrated in FIG. 1, because the fixed blade 31 and the movable blade 32 are arranged a distance apart from the lower paper guide 35 as illustrated in FIGS. 2 and 3, a space is formed between the fixed and movable blades 31, 32 and the lower paper guide 35. The printed recording paper 10 sags downward by gravity and also curls downward in a case where the recording paper 10 is rolled. Therefore, the recording paper 10 tends to enter the space between the fixed and movable blades 31, 32 and the lower paper guide 35. Particularly, in a case where the recording paper has low resiliency or a strong curling property, the recording paper 10 tends to enter the space between the fixed and movable blades 31, 32 and the lower paper guide 35. When the recording paper 10 (e.g., particularly, recording paper having low resiliency) enters the space between the fixed and movable blades 31, 32 and the lower paper guide 35, the recording paper 10 tends to fold midway of the space and become caught between the lower paper guide 35 and the upper paper guide 36. This results in jamming of the recording paper 10.

This problem may be resolved by shortening the distance between the fixed and movable blades 31, 32 and the lower paper guide 35. However, as described above, the fixed blade 31 is attached to the housing 37 by the screw 38, and the lower paper guide 35 is also fixed to the housing 37 by a screw (not illustrated). Therefore, shortening the distance between the fixed and movable blades 31, 32 and the lower paper guide 35 is not easy because a substantial amount of space is required for installing the screw 38.

Further, the lower recording guide 35 is formed with a slope oriented upward to the discharging direction. This slope causes the recording paper 10 to become lodged or curled. As a result, the recording paper 10 is prevented from being conveyed, and jamming may occur in the discharge port 34.

(Cutter Apparatus and Printer)

Figure 4:
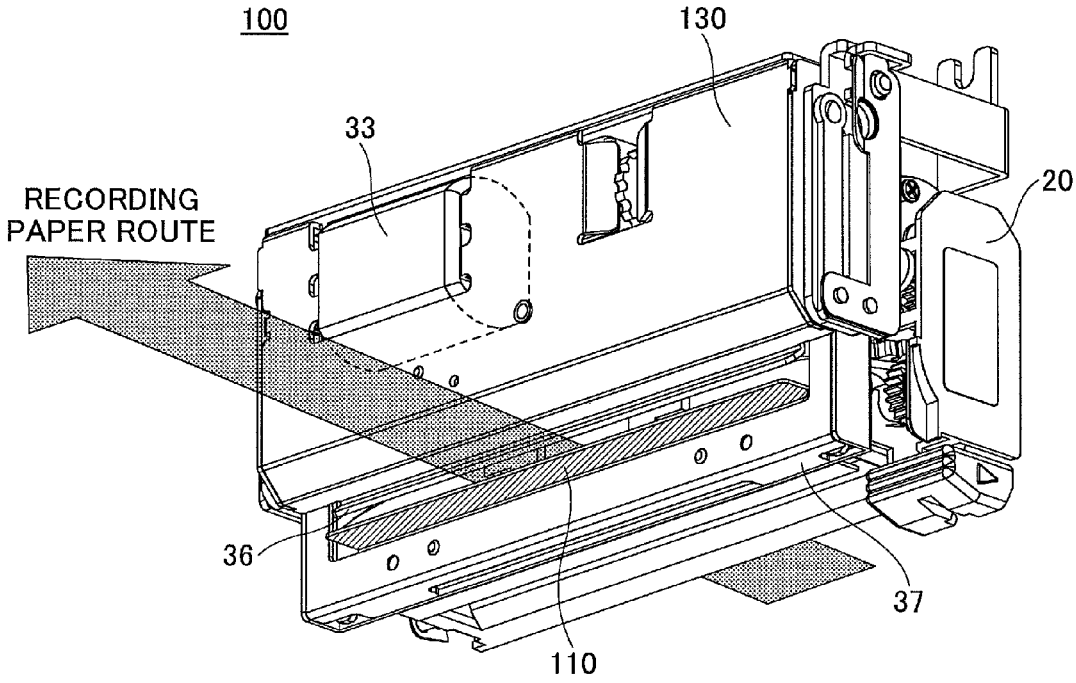
FIG. 4 is a perspective view illustrating a printer according to an embodiment of the present invention.
Figure 5:
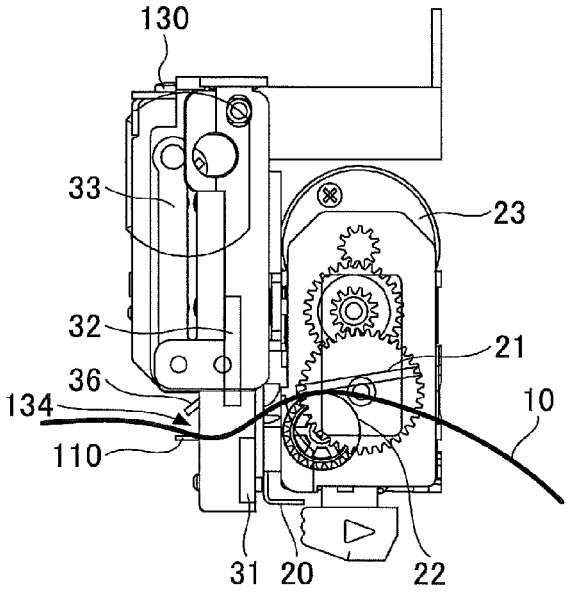
FIG. 5 is a schematic diagram illustrating a structure of a printer according to an embodiment of the present invention.

Next, a cutter apparatus 130 and a printer 100 according to an embodiment of the present invention are described. As illustrated in FIGS. 4 and 5, the printer 100 performs printing on a rolled recording paper 10. The printer 100 includes, for example, a printer body 20 and a cutter apparatus 130. FIG. 4 is a perspective view illustrating the printer 100 according to an embodiment of the present invention. FIG. 5 is a side view illustrating an internal structure of the printer 100.

The printer body 20 includes, for example, a thermal head 21 serving as a print head for performing printing on the recording paper 10, a platen roller 22, and a conveying motor 23 for conveying the recording paper 10. The recording paper 10 is fed into the printer body 20 from a transfer port of the printer body 20. The cutter apparatus 130 includes a fixed blade 31, a movable blade 32, a movable blade motor 33 for driving the movable blade 32, and a gear (not illustrated) for transmitting dynamic force of the rotation of the movable blade motor 33 to the movable blade 32.

By rotating the conveying motor 23 in a state where the recording paper 10 is sandwiched between the thermal head 21 and the platen roller 22 in the printer body 20, the platen roller 22 rotates to convey the recording paper 10. In the printer body 20, the thermal head 21 performs printing on the recording paper 10 being conveyed by the rotation of the platen roller 22.

Then, the printed recording paper 10 is cut by the cutter apparatus 130. That is, after the printed recording paper 10 is conveyed to a predetermined position, the recording paper 10 is cut by the fixed blade 31 and the movable blade 32 by moving the movable blade 32 to a side of the fixed blade 31 by driving the movable blade motor 33. In the printer 100 of this embodiment, the cutter apparatus 130 includes a discharge port 134 for discharging the cut recording paper 10. The discharge port 134 is formed by an upper paper guide 36 and a lower paper guide 110 having a T-shape.

Figure 6:
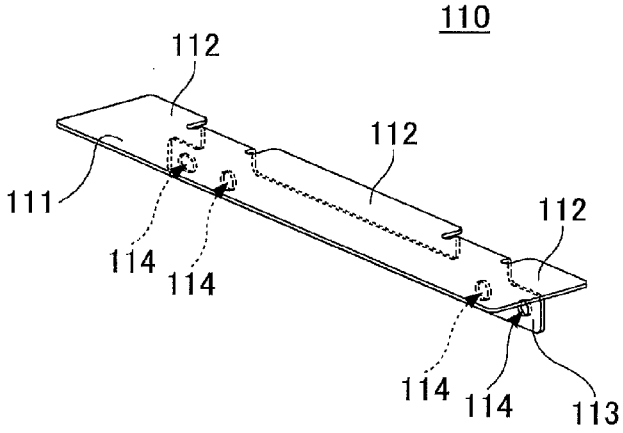
FIG. 6 is a schematic diagram illustrating a structure of a lower paper guide of a cutter apparatus according to an embodiment of the present invention.
Figure 7:
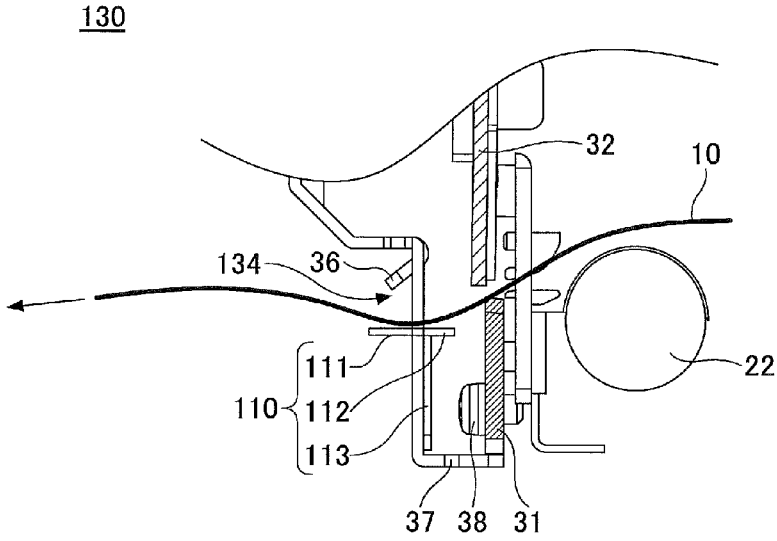
FIG. 7 is a schematic diagram for describing a cutter apparatus according to an embodiment of the present invention.

The lower paper guide 110 is formed by bending a plate formed of a metal material (e.g., stainless steel). As illustrated in FIGS. 6 and 7, the lower paper guide 110 includes an outer guide part 111, an inner guide part 112, and a support part 113. More specifically, the lower paper guide 110 is made of a metal plate including an area that forms the outer guide part 111, an area that forms the inner guide part 112, and an area that forms the support part 113. By bending the metal plate at the area that forms the support part 113, the lower paper guide 110 is formed. In the example illustrated in FIGS. 6 and 7, the lower paper guide 110 is formed so that the outer guide part 111 and the inner guide part 112 are formed on the same plane.

The lower paper guide 110 is formed so that the surface of the outer guide part 111 and the surface of the inner guide part 112 are oriented along the discharging direction of the recording paper 10 (e.g., parallel to the discharging direction of the recording paper 10) in a state where the lower paper guide 110 is attached to the housing 37. In the lower paper guide 110, the support part 113 includes a screw hole 114 for connecting the support part 113 to the housing 37 of the cutter apparatus 130 by way of a screw (not illustrated) or the like. The outer guide part 111 extends outward from the housing 37 of the cutter apparatus 130 for guiding the recording paper 10 on the outer side of the discharge port 134. The inner guide part 112 extends inward from the housing 37 of the cutter apparatus 130 for guiding the recording paper 10 on the inner side of the discharge port 134.

By providing the inner guide part 112 to the lower recording guide 110, the distance from the fixed and movable blades 31, 32 to the lower recording guide 110 becomes short. Thereby, the space between the fixed and movable blades 31, 32 and the lower paper guide 110 can become narrower without having to shorten the distance between the fixed and movable blades 31, 32 and the lower paper guide 110. Accordingly, even in a case where the recording paper 10 has low resiliency or a strong curling property, the recording paper 10 can be prevented from entering the space between the fixed and movable blades 31, 32 and the lower paper guide 110. Therefore, the recording paper 10 can be prevented from being jammed in the discharge port 134.

In the cutter apparatus 130 of this embodiment, the lower paper guide 110 is formed, so that the surface of the outer guide part 111 and the surface of the inner guide part 112 are oriented along the discharging direction of the recording paper 10. In contrast, the lower paper guide 35 of the cutter apparatus 30 illustrated in FIG. 3 is inclined. Accordingly, with the cutter apparatus 130 of this embodiment, the recording paper 10 can be prevented from being lodged or curled at the outer guide part 111 and the inner guide part 112. Thereby, the recording paper 10 can be smoothly conveyed.

Figure 8A:
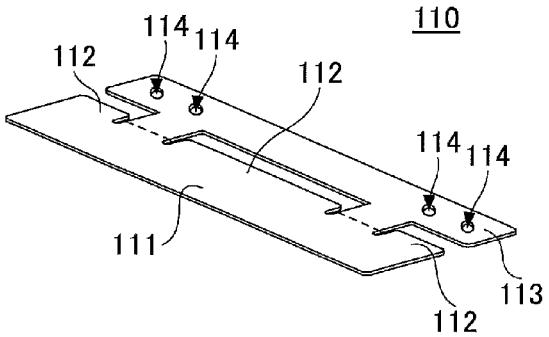
FIGS. 8A and 8B are schematic diagrams for describing a cutter apparatus according to an embodiment of the present invention.
Figure 8B:
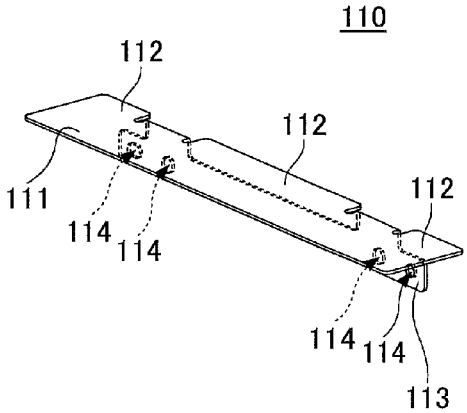

Next, a method for manufacturing the lower paper guide 110 of the printer 100 according to an embodiment of the present invention is described. A single metal plate stamped for forming the lower paper guide 110 as illustrated in FIG. 8A is bent along the dotted line of FIG. 8A as illustrated in FIG. 8B. The outer guide part 111 and the inner guide part 112 are formed to be on the same plane. In the example of FIG. 8B, the inner guide part 112 is formed in three parts of the lower paper guide 110, that is, the parts of the lower paper guide 110 corresponding to both ends of the recording paper 10, and the center part of the lower paper guide 110. However, the number of the inner guide parts 112 to be provided is not limited to three. Further, the inner guide parts 112 may be positioned differently from the example illustrated in FIG. 8B. The metal plate may be arbitrarily bent, so that the inner guide part 112 has suitable length corresponding to the distance between the fixed and movable blades 31, 32 and the discharge port 134.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A cutter apparatus comprising:

a fixed blade;

a movable blade that moves toward the fixed blade to cut a recording paper;

a housing to which the fixed blade is attached; and a discharge port for discharging the recording paper;

wherein the discharge port includes a lower paper guide attached to the housing for guiding a lower side of the recording paper, and wherein the lower paper guide includes an inner guide part formed on an inner side of the housing toward a side of the fixed blade and the movable blade, an outer guide part formed on an outer side of the housing, and a support part attached to the housing.

2. The cutter apparatus as claimed in claim 1, wherein the lower paper guide is formed by bending a metal plate.

3. The cutter apparatus as claimed in claim 2, wherein the metal plate includes an area for forming the inner guide part, an area for forming the outer guide part, and an area for forming the support part, and the lower paper guide is formed by bending the area for forming the support part.

4. The cutter apparatus as claimed in claim 1, wherein the inner guide part and the outer guide part are formed to be parallel to a direction in which the recording paper is discharged.

5. The cutter apparatus as claimed in claim 1, wherein the lower paper guide includes a screw hole for attaching the lower paper guide to the housing by way of a screw.

6. A printer comprising:

the cutter apparatus of claim 1; and a print head for performing printing on the recording paper;

wherein the cutter apparatus is configured to cut the recording paper on which the printing is performed by the print head.

* * * * *

UNITED STATES PATENT AND TRADEMARK OFFICE

CERTIFICATE OF CORRECTION

PATENT NO. : 9,073,371 B1
APPLICATION NO. : 14/628369
DATED : July 7, 2015
INVENTOR(S) : Tetsuhiro Ishikawa et al.

It is certified that error appears in the above-identified patent and that said Letters Patent is hereby corrected as shown below:

Title page

Please enter the Item (30) Foreign Application Priority Data:
"Feb. 28, 2014 (JP) 2014-039617"

Signed and Sealed this
First Day of December, 2015

Michelle K. Lee

Michelle K. Lee
*Director of the United States Patent and Trademark Office*